United States Patent [19]

Sakamoto et al.

[11] Patent Number: 4,992,782

[45] Date of Patent: Feb. 12, 1991

[54] CHARACTER AND GRAPHICS DATA DISPLAY APPARATUS HAVING DATA COMPRESSION CAPABILITY

[75] Inventors: Ken Sakamoto, Kyoto; Hidemi Henmi, Ootsu; Tomoji Kondo, Osaka; Hiroyasu Shimbo, Osaka; Shin Fukuda, Osaka, all of Japan

[73] Assignee: Matsushita Electric Industrial Co., Ltd., Japan

[21] Appl. No.: 223,695

[22] Filed: Jul. 22, 1988

[30] Foreign Application Priority Data

Jul. 24, 1987 [JP] Japan ..... 62-186238

[51] Int. Cl.[5] ..... G09G 1/14

[52] U.S. Cl. ..... 340/747; 340/734; 358/183

[58] Field of Search ..... 340/749, 728, 731, 734, 340/735, 748; 358/22, 180, 183; 382/44, 45, 47

[56] References Cited

U.S. PATENT DOCUMENTS 4,580,134 4/1986 Campbell et al. ..... 340/747
4,633,299 12/1986 Skerlos et al. ..... 358/183
4,665,433 5/1987 Hinson et al. ..... 358/183
4,707,742 11/1987 Field et al. ..... 358/183
4,712,140 12/1987 Mintzer et al. ..... 340/731
4,725,892 2/1988 Suzuki et al. ..... 340/731
4,779,135 10/1988 Judd ..... 358/183

*Primary Examiner*—Alvin E. Oberley
*Assistant Examiner*—M. Fatahiyar
*Attorney, Agent, or Firm*—Lowe, Price, LeBlanc, Becker & Shur

[57] ABSTRACT

A character and graphics display device for displaying character and graphics data which includes a receiving circuit for deriving the character and graphics data from a signal carrying that data encoded therein, a memory for storing the received data, a decoder circuit for decoding the encoded data into suitable form for transfer to a display device, and a display memory for temporarily storing this decoded data, further includes compression circuits for converting the decoded data into a form whereby patterns represented by that data are displayed in compressed size. Pattern and graphics data can thereby be displayed together with other data such as a television picture, or a number of pages of the character and graphics data can be displayed simultaneously.

10 Claims, 5 Drawing Sheets

CHARACTER AND GRAPHICS DATA DISPLAY APPARATUS HAVING DATA COMPRESSION CAPABILITY

BACKGROUND OF THE INVENTION

The present invention relates to a character and graphics data display apparatus for performing decoding processing of character and graphics data which are received in encoded form carried by a signal such as a television signal, for example contained in the vertical blanking intervals of a television signal, and for displaying the decoded data.

In recent years, various forms of television broadcasting multiplex systems have been envisaged, which utilize broadcast radio waves. Of these, a television character multiplex broadcasting called the teletext system has been put into practical application for domestic use, whereby character and graphics data concerning news, weather reports, stock market conditions etc. can be displayed by a home television receiver. The term "character and graphics data" as used herein signifies data representing characters and/or numerals, or graphic images, or a combination of these. Another system, called videotext has also been put into practice, in which the public telephone lines are used to transmit character and graphics data to be displayed on television receiver screens.

In the following, a prior art videotext character and graphics data display apparatus of the type described above will be outlined, referring to FIG. 1. In FIG. 1, numeral 1 denotes a character and graphics data decoding section for decoding character and graphics data which are encoded in a television broadcast signal (e.g. encoded within the vertical blanking intervals) and processing the decoded data to produce a video signal which can be applied to drive a television display to display a selected part of that character and graphics data. As described in detail hereinafter, the character and graphics data includes display control data which designates for example the display density with which the character and graphic picture data are to be displayed. A portion of this data which can be displayed at one time on the television screen is generally referred to as a data "page", and the received character and graphics data consists of a plurality of such pages which can be selected by the user as described in the following. Numeral 2 denotes a microprocessor for controlling the character and graphics data decoding section 1 and executing decoding operations. Commands and data are transferred between the microprocessor 2 and other circuits over a bus 20. A receiver circuit 3 serves to extract character and graphics data from a television signal, as digital data. A RAM 4 functions to store the received character and graphics data and to provide a working region for operation of the microprocessor 2. Numeral 5 denotes a ROM which stores a program for controlling the operation of the microprocessor 2. Numeral 7 denotes a display memory, for storing character and graphic picture data that have been decoded by the microprocessor 2. Numeral 6 denotes a display processing circuit for synthesizing an RGB color video signal from the character and graphic picture data that has been stored in the display memory 7. A character generator 9 is utilized during decoding of the character and graphics data into character and graphic picture data. Numeral 8 denotes an auxiliary sound decoder for processing auxiliary sound data which may be contained in the character and graphics data. Numeral 10 denotes a key pad, actuatable by the user for designating selection by the character and graphics data decoding section 1 of specific data, e.g. overall selection of desired character and graphics data, and selection of pages of that data to be displayed. Numeral 20 denotes a television signal receiving section, 21 denotes an antenna, 22 a television signal receiving circuit, 23 an audio demodulator/amplifier circuit, and 24 a luminance amplifier/chrominance demodulator circuit. Numeral 25 denotes a video and audio switching circuit which is operable for selecting either the video and sound signals from the sound demodulator/amplifier circuit 23 and luminance amplifier/demodulator circuit 24, or for superimposing the RGB signal from the character and graphics data decoding section 1 upon the video signal from the luminance amplifier/demodulator circuit 24 while selecting the sound signal from the sound demodulator/amplifier circuit 23, or for selecting the auxiliary sound signal and the RGB signal from the character and graphics data decoding section 1 (in the event that there is auxiliary sound information present and there is no sound signal being produced from the sound demodulator/amplifier circuit 23). The selected sound and video signals thus derived by the selector circuit 25. The resulting output sound signal and output video signal from the video and sound signal switching circuit 25 are respectively supplied to a sound amplifier output circuit 26 and a video amplifier output circuit 27, to drive a loudspeaker 28 and a display device 29 respectively.

The operation of this prior art character and graphics data display apparatus is as follows. A television signal that is received from the antenna 21 is demodulated by the television signal receiving circuit 22 of the television signal receiving section 20, to derive a television sound and video signal respectively. The television video signal is supplied to the receiving circuit 3 of the character and graphics data decoding section 1, whereby character and graphics data are extracted from that video signal. The user can select desired data to be displayed, from among a variety of information constituting the latter character and graphics data, by actuating the keypad 10 to designate to the microprocessor 2 the data which are to be selected. The microprocessor 2 responds by selecting the specified character and graphics data and stores that data in the RAM 4, and also executes decoding processing of the selected character and graphics data in accordance with the stored program held in the ROM 5, to obtain character and graphic picture data which is in a suitable format for subsequent transfer to be displayed by the display device 29, and temporarily stores this character and graphic picture data in the display memory 7. If the character and graphics data contains data which specify as corresponding code values certain predetermined patterns such as shapes of characters or numerals etc (as described hereinafter), then the character generator 9 is utilized in this data decoding processing for generating corresponding character pattern data, as part of the character and graphic picture data that are stored in the display memory 7. The display processing circuit 6 operates on this stored character and graphic picture data to generate the aforementioned RGB color video signal that is supplied to the video and sound signal switching circuit 25.

If the stored character and graphics data in the RAM 4 contain auxiliary sound data, then this is converted by the auxiliary sound decoder 8 into a suitable audio signal for transfer through the video and sound signal switching circuit 25 to the loudspeaker 28.

When a normal television picture is to be displayed, the sound and video signals produced by the television signal receiving section 20 are respectively transferred by the video and sound signal switching circuit 25 to drive the loudspeaker 28 and display device 29 respectively. When character and graphics data are to be displayed, the RGB signal from the character and graphics data decoding section 1 are selected by the video and sound signal switching circuit 25 to drive the display 29. In this condition, auxiliary sound signals are transferred to drive the loudspeaker 28, but only if there is no sound signal component in the television signal being received at that time. Thus the user can select either a normal television picture or a page of character and graphics data to appear on the display device 29.

It can be understood from the above that such a prior art character and graphics data display apparatus has the disadvantage that it is only possible to view (at one time) either a normal television picture or a character and graphics data display. While the user is operating the keypad 10 to select desired character and graphics data, it is not possible for the user to view a television picture. Furthermore, such a prior art apparatus also has the disadvantage that it is only possible to display a single page of character and graphics data on the display device 29 at one time.

SUMMARY OF THE INVENTION

It is an objective of the present invention to overcome the disadvantages of the prior art described above, by providing a character and graphics data display apparatus whereby a television picture and a page of character and graphics data can be displayed simultaneously by a display device It is a further objective of the present invention to provide a character and graphics data display apparatus whereby a plurality of pages of character and graphics data can be displayed simultaneously by a display device.

To attain the objectives set out above, a character and graphics data display apparatus according to the present invention comprises means for converting character and graphics data to corresponding data in which compression of patterns represented by the data and compression of associated attribute data has been executed, so that each page of the converted data will occupy only a portion of a display screen when displayed.

More specifically, a character and graphics data display apparatus according to the present invention includes a display device, receiving circuit means for receiving a signal carrying encoded therein character and graphics data, the character and graphics data including display control data, data memory means for storing the character and graphics data received by the receiving circuit means, data decoding means for decoding the character and graphics data to obtain character and graphics picture data, display memory means for temporarily storing the character and graphics picture data, and display processing circuit means for processing the stored character and graphics picture data to suitable form for display by the display device, and is characterized in further comprising conversion means for converting the character and graphics picture data, prior to storage in the display memory means, to compressed character and graphic picture data representing a display picture having a display density which is different from a display density specified by the display control data.

DESCRIPTION OF PREFERRED EMBODIMENTS

Figure 1:
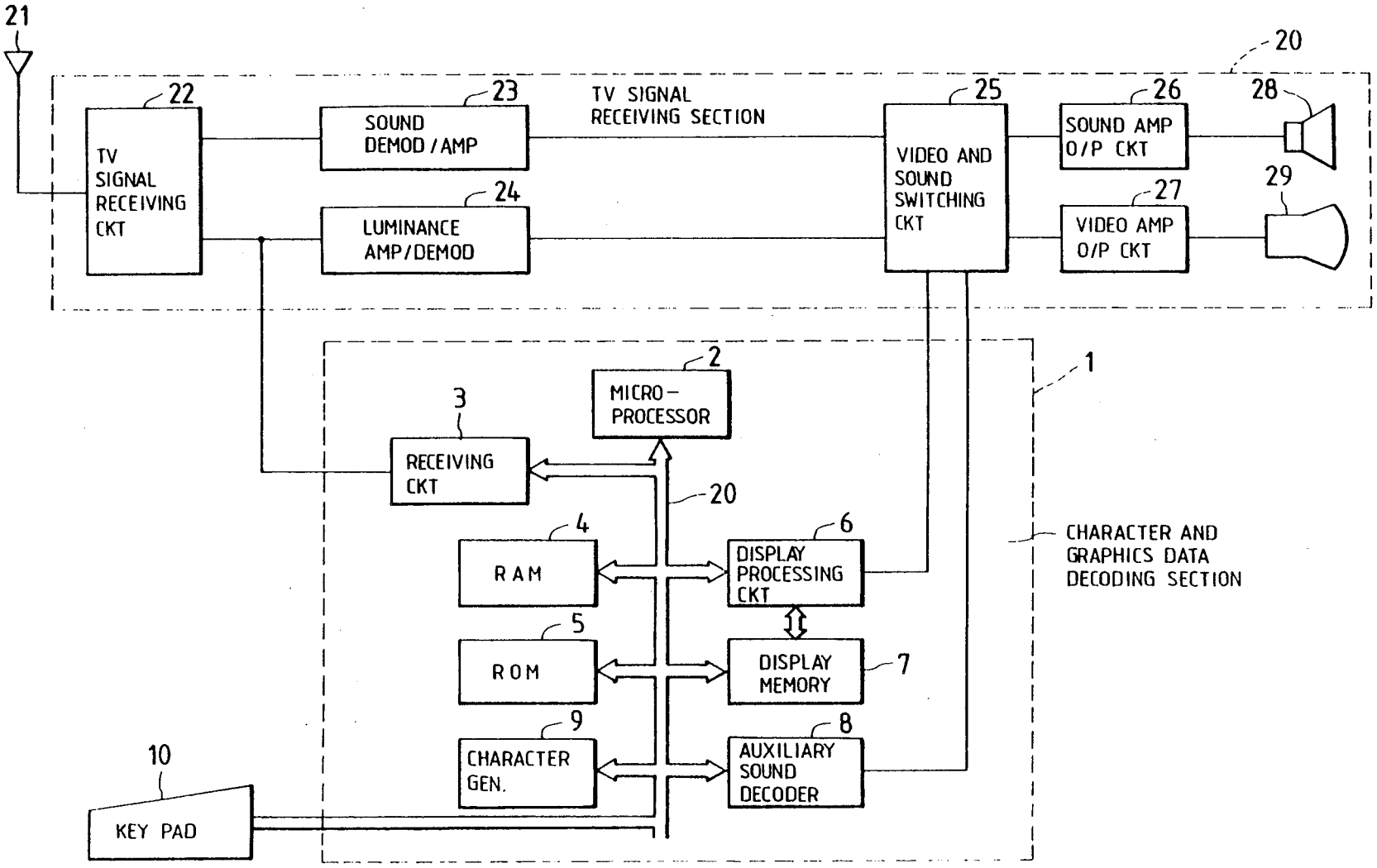
FIG. 1 PRIOR ART
FIG. 1 is a general block system diagram of a prior art character and graphics data display apparatus.
Figure 2:
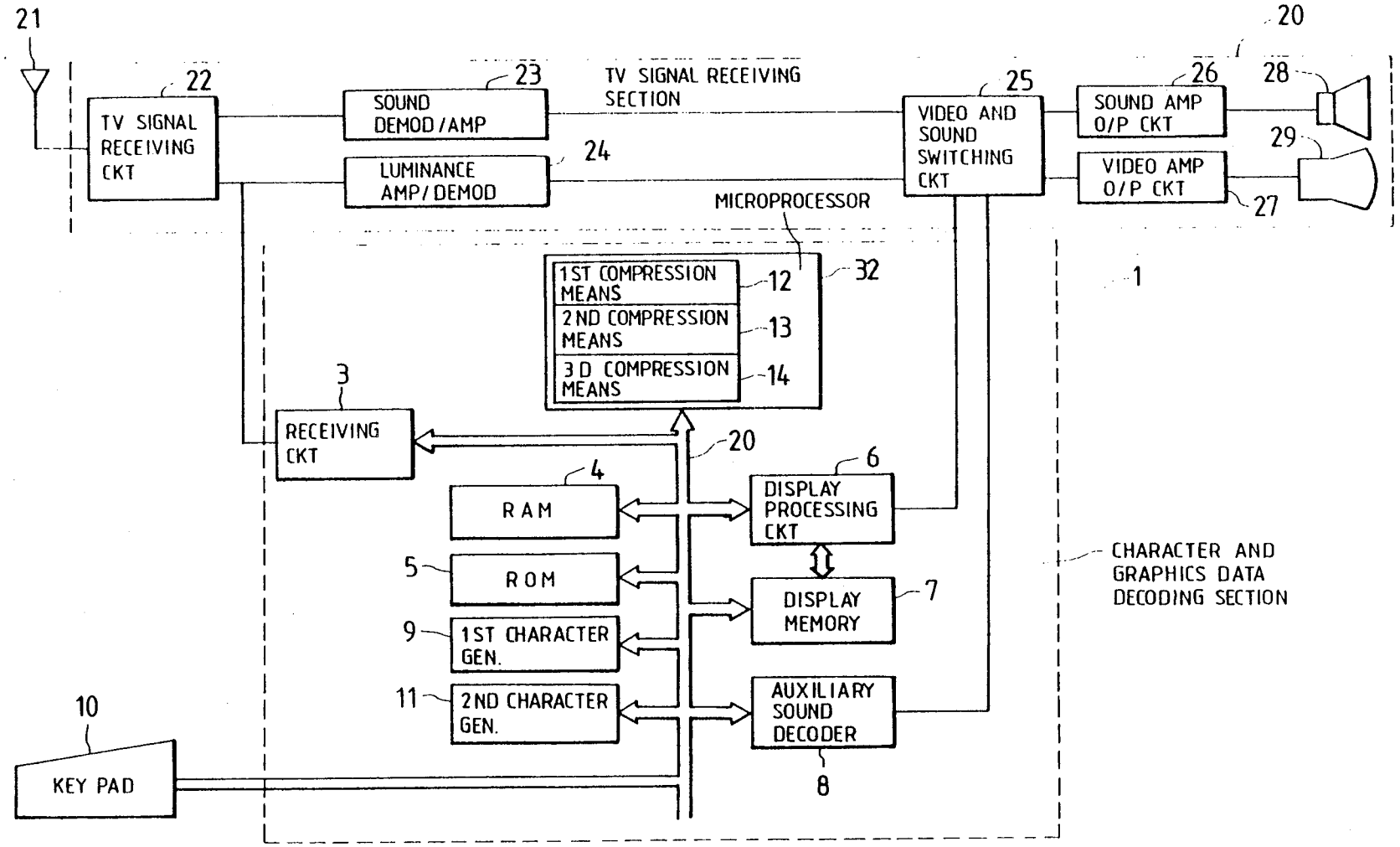
FIG. 2 is a general block system diagram of a preferred embodiment of a character and graphics data display apparatus according to the present invention.

FIG. 2 shows the general configuration of an embodiment of a character and graphics data display apparatus according to the present invention. The overall arrangement is similar to that of the prior art example of FIG. 1 described above, and components corresponding to components in that prior art example are designated by corresponding reference numerals. Detailed description of these will be omitted. In addition to a receiving circuit 3, a RAM 4, a ROM 5, a display processing circuit 6, a display memory 7, an auxiliary sound decoder 8, and a character generator 9 (referred to in the following as the first character generator), a character and graphics data decoding section 31 includes a second character generator 11 for generating character patterns in compressed form, and has a microprocessor 32 which functions to implement a first compression means 12, a second compression means 13 and a third compression means 14, described in detail hereinafter. For precision of description, the RAM 4 will be referred to as a "data memory", to distinguish this from the display memory 7. The second character generator 11 operates in basically the same manner as the first character generator 9. However whereas the first character generator 9 generates data for producing display of patterns (e.g. representing characters or numerals) of predetermined display size for the case in which a single page of character and graphics data occupies the entire display screen of the display device 29, the second character generator 11 generates data for producing display of these patterns in compressed form, i.e. reduced display size as is required when a page of character and graphics data occupies only a portion of the display screen of the display device 29.

Figure 5:
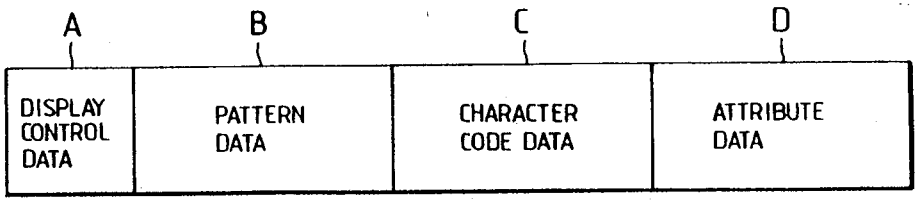
FIG. 5 is a diagram showing an example of configuration of character and graphics data.

The format of the character and graphics data derived by the receiving circuit 3 is illustrated in FIG. 5, and consists of data A which specifies the display density for the character and graphics data, pattern data B which represents patterns that are to be formed by arrangements of arbitrary picture elements of the display device, character code data C consisting of code values corresponding to predetermined pattern shapes (e.g. of characters, numerals etc.) which are converted to pattern data by a character generator, and attribute data D which specifies the display attributes for patterns to be displayed (e.g. pattern color, background color, etc.).

Figure 3:
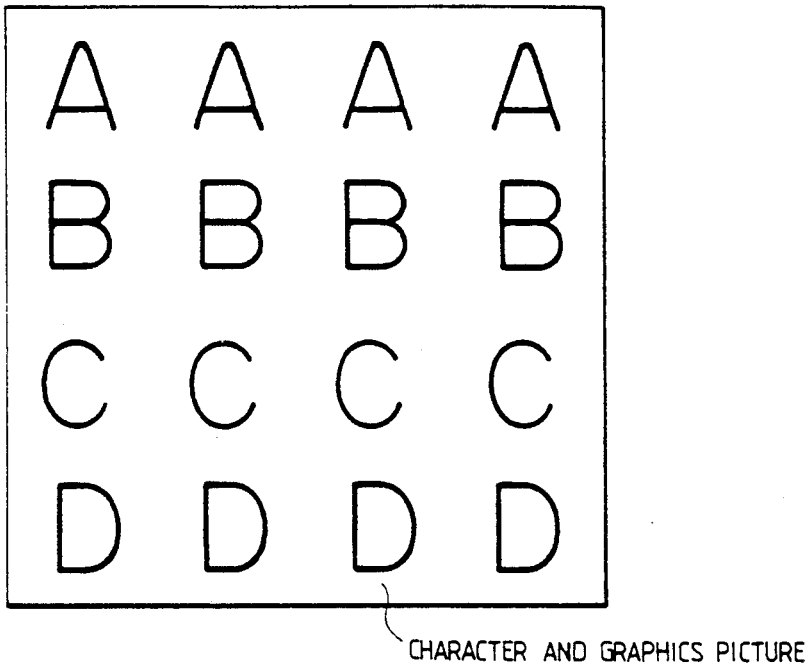
FIG. 3 shows an example of a page of character and graphics data displayed with the display density being as specified by display control data.

It is possible to operate this embodiment in essentially the same manner as the prior art example of FIG. 1. In this case, the user can operate the keypad 10 to display either a page of desired character and graphics data which occupies the entire display screen of the display device 29, with the display density (which determines the number of picture elements utilized to form each pattern on the display screen) being as specified by the display control data A (for example as illustrated in FIG. 3) or a normal television picture, as described hereinabove referring to FIG. 1.

Figure 4:
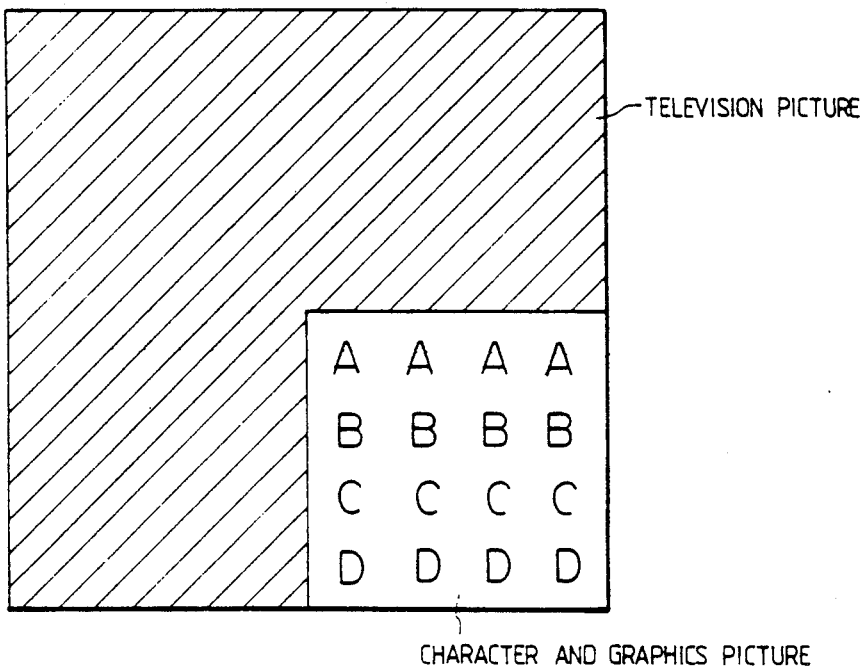
FIG. 4 shows an example of a page of character and graphics data displayed in compressed form in combination with a television picture.
Figure 6B:
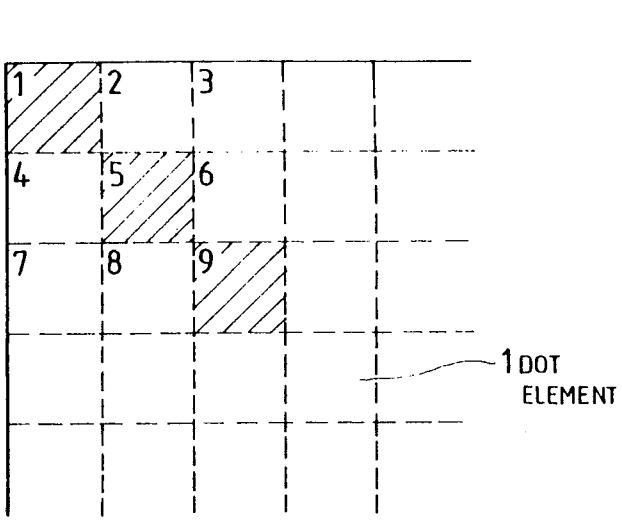
FIG. 6 is a diagram for assistance in describing an example of compression of pattern data by first compression means of the described embodiment.
Figure 6A:
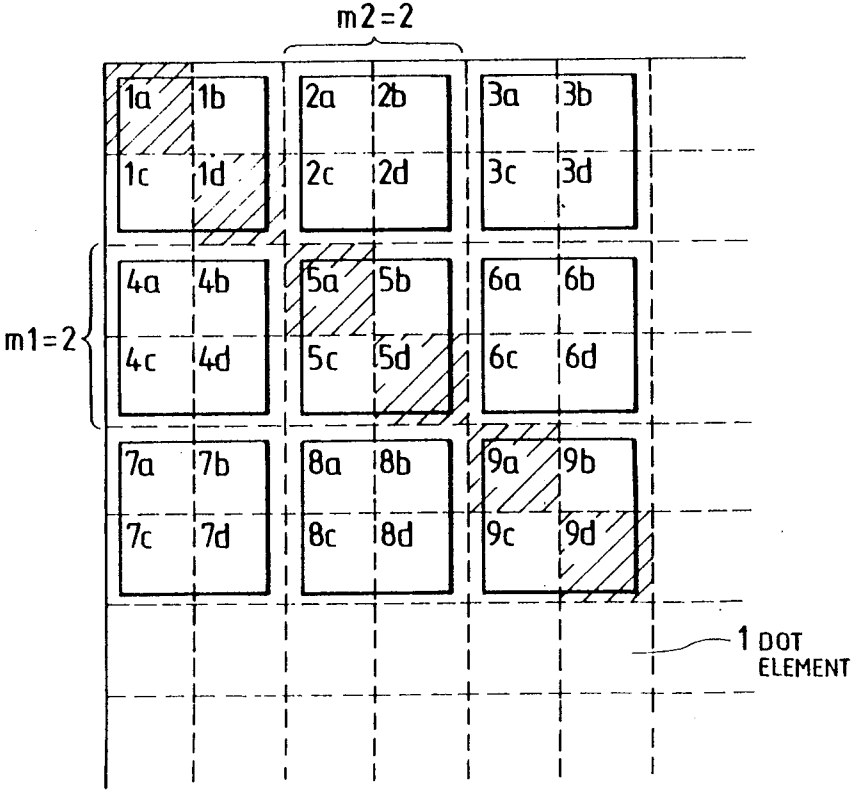

However this embodiment also permits the user to designate display of character and graphics data in compressed form, to enable a page of character and graphics data to be displayed simultaneously with a television picture (for example as illustrated in FIG. 4). In this case, conversion processing is executed on the character and graphics data supplied from the receiving circuit 3, to display the data contents with a display density that is different from that specified by the display control data A. To do this, it is necessary to execute compression of the pattern data B shown in FIG. 5, and a method of performing this will be described referring to FIG. 6A which graphically illustrates an example of part of the pattern data prior to compression, and FIG. 6B which shows the result of compressing that data. In this example, the "dot" elements of the pattern represented by the pattern data B, (each of these dot elements corresponding to a specific minimum-size display element of the display device 29) are processed as sets which respectively correspond to rectangular arrays of picture elements, referred to in the following as picture segments, each of which has a vertical height (designated herein as $m_1$) equal to 2 picture elements in this example, and a horizontal width (designated as $m_2$) equal to 2 picture elements in this example, i.e. each of the sets represents a $2\times2$ element array of 4 picture elements. Each of these sets of dot elements of the pattern data are compressed to a single dot element, as shown in FIG. 6B. That is, the picture segment corresponding to dot elements 1*a*, 1*b*, 1*c* and 1*d* shown in FIG. 6A is compressed to the single dot element 1 shown in FIG. 6B. Similar compression is executed for the set of dot elements 2*a*, 2*b*, 2*c*, 2*d*, the set 3*a*, 3*b*, 3*c*, 3*d* and so on. Each of the dot elements of the pattern data shown in FIG. 6A represents a bi-level bit status, i.e. a "1" or "0" state, for example respectively corresponding to an "ON" display state (normally a "bright" state) and an "OFF" display state (normally a "dark" state). The "ON" display state is indicated in FIGS. 6A, 6B by each a hatched-line square, while the "OFF" state is indicated by each blank square Pattern compression is performed in this embodiment as follows. If at least one dot element of one of the aforementioned sets represents the display "ON" state, then the single dot element corresponding to that set after compression is set as the "ON" state. If all of the dot elements of a set represent the "OFF" display state, then the corresponding single dot element following compression is set as the "OFF" state. The resultant data elements from this compression conversion processing will be referred to as the compressed character and graphic picture data.

The above operation is clearly illustrated in FIGS. 6A, 6B. For example after compression, the single dot element 1 in FIG. 6B corresponding to the set 1*a*, . . . 1*d* in FIG. 6A is placed in the "ON" state, since two dot elements 1*a*, 1*d* of that set are in the "ON" state. Similarly, the dot element 2 in FIG. 6B represents the display "OFF" state, since all of the dot elements of the corresponding set 2*a*, . . . . 2*d* represent the display "OFF" state. In this way the diagonal line pattern represented by the data in FIG. 6A is compressed to the diagonal line pattern represented by the data shown in FIG. 6B.

In this embodiment, the display "ON" state is represented by a logic "1" data value, and the display "OFF" state by logic "0". The above compression operation is executed for each of the dot element sets 1*a*, . . . 1*d*, 2*a*, . . . . 2*d*, etc. by taking the logical sum (i.e. the OR function) of the states of the dot elements in that set and establishing the resultant state as that of the corresponding compressed dot element. Thus since for example the dot elements of the set 1*a* to 1*d* shown in FIG. 6A consist of two "ON" state elements and two "OFF" state elements, the logical sum of these states represents the display "ON" state, which is thus established for the corresponding element 1 in the compressed data shown in FIG. 6B, as described above.

Similarly, the logical sum of the states of the dot elements 2*a* to 2*b* in FIG. 6A (all "OFF" state, i.e. all "0" level) is the "OFF" state which is thus established for the corresponding dot element 2 in the compressed data shown in FIG. 6B. Similar compression processing is executed for the other sets of dot elements corresponding to respective picture segments, shown in FIG 6A.

The above compression processing is executed by the first compression means 12 of the microprocessor 32, and the resultant compressed data are stored in the display memory 7.

In the case of the character code data C shown in FIG. 5, the data are supplied under the control of the second compression means 13 of the microprocessor 32 to the second character generator 11, which responds by generating compressed character/graphics pattern data (e.g. for producing the compressed characters shown in FIG. 4), which are stored in the display memory 7.

Figure 7A:
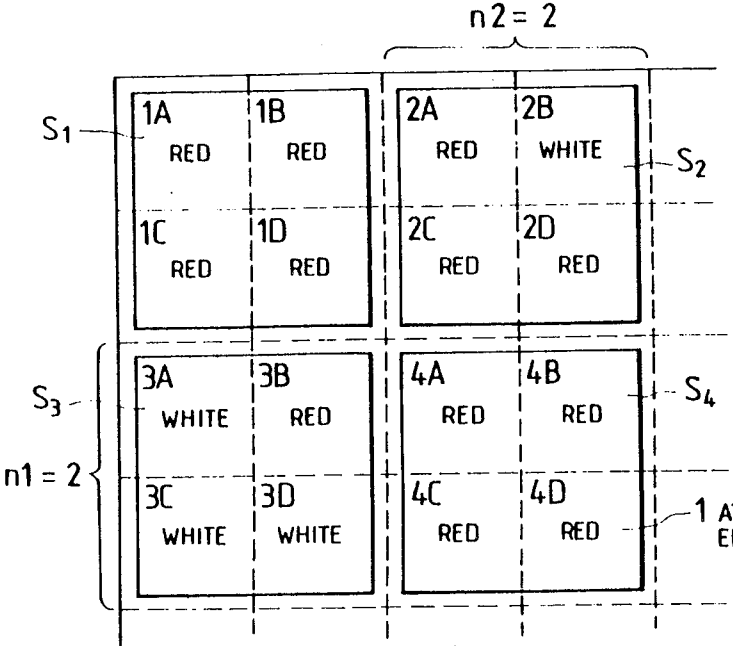
FIG. 7 is a diagram for assistance in describing an example of compression of attribute data by third compression means of the described embodiment; and, FIG. 8 shows an example of simultaneous display of a plurality of pages of character and graphics data on a display screen.
Figure 7B:
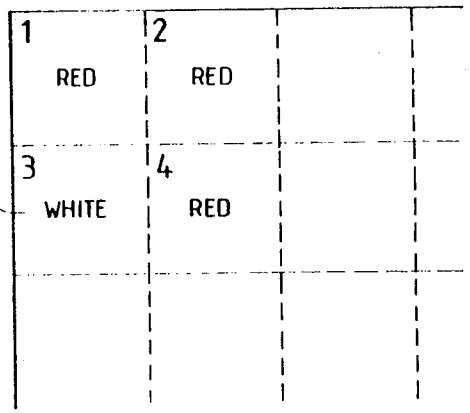

The compression processing of the attribute data D shown in FIG. 5 will be described referring to FIGS. 7A, 7B. As in the case of the pattern data described above, the attribute data are processed for compression as sets $S_1$, $S_2$, . . . . . , of attribute data elements, 1A to 1C, 2A to 2D, and so on. Each of these attribute data elements defines an attribute (in this example, display color) for a specific display region made up of one or more display elements of the display device 29, and each of the aforementioned sets of attribute data elements corresponds to a display segment made up of a rectangular array of these display regions. Each of the sets $S_1$, $S_2$, . . . . is formed of $n_1$ attribute elements vertically by $n_2$ attribute elements horizontally as shown in FIG. 7A, where $n_1$ and $n_2$ are positive integers each of which in this example is 2, and each of the attribute element sets $S_1$, $S_2$, . . . . . is compressed, i.e. converted to a single attribute element of the compressed character and graphics picture data. Compression is executed by determining, for each of these attribute element sets $S_1$, $S_2$, etc., the color which is specified by the greatest number of elements within that array (if such a majority exists), and assigning that color to the corresponding attribute element of the compressed data shown in FIG. 7B. Thus for example since the color red is specified by three of the attribute elements in picture segment $S_2$, the corresponding attribute element of the compressed attribute data specifies red. Similar processing is executed for each of the other element arrays of the attribute data. If a "majority color" decision cannot be made, due to any of the sets $S_1$, $S_2$, etc., containing two pairs of attribute elements for mutually different colors, or four attribute elements for respectively different colors, then the color of an element in a fixedly predetermined position of the set (for example position 1B, 2B, 3B, 4B, . . . . in FIG. 6) is arbitrarily established as the color to be specified by the corresponding attribute data element in the compressed data shown in FIG. 7B. Since each of these sets corresponds to only a very small display area, this is not a serious problem in practice.

This attribute data compression processing is carried out by the third compression means 14 of the microprocessor 32, and the results are stored in the display memory 7.

To display a compressed character and graphics data picture together with a television picture, as shown in FIG. 4 for example, the contents thus stored in the display memory 7 as described above are read out and processed by the display processing circuit to obtain an RGB color signal. This is combined in the switching circuit 25 with the television video signal produced from the amplifier/demodulator circuit 24, to produce a video signal for providing a combined display of the form shown in FIG. 4, by inserting the aforementiond RGB color signal into the television video signal at appropriate timings in specific horizontal scanning intervals. Methods of implementing such combination of video signals from different sources to obtain a combined display picture are well known in the art, so that no detailed description will be given herein.

Figure 8:
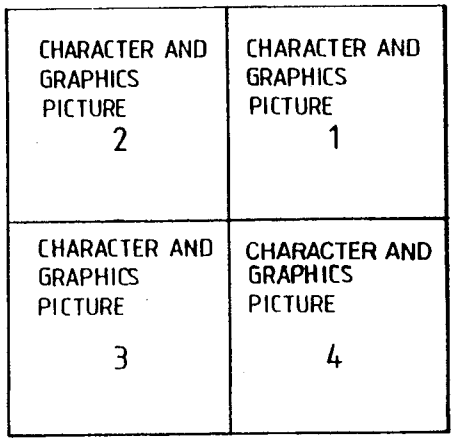

In the example described above, a single page of character and graphics data are displayed in combination with a television picture. However it is equally possible to store a plurality of pages of character and graphics data (containing respectively different or mutually identical data) in the display memory 7 and to display these pages simultaneously by the display device 29, i.e. to occupy the entire display screen as illustrated in FIG. 8.

In the above description it is assumed that the quantities $m_1$, $m_2$, $n_1$, $n_2$, each have the value 2. However it should be noted that the invention is not limited to such values for these quantities, and that various other values could be utilized.

It should also be noted that the attribute data can also consist of data specifying foreground color, background color, flashing, concealment, etc., and that the method of compression described above is applicable to all of these.

What is claimed is:

1. In a character and graphics display apparatus for enabling substantially simultaneous display of a television picture and a set of character and graphics data by a display device, having receiving circuit means for receiving a signal carrying encoded therein character and graphics data, said character and graphics data including display control data, data memory means for storing said character and graphics data received by said receiving circuit means, data decoding means for decoding said character and graphics data to obtain character and graphics picture data, display memory means for temporarily storing said character and graphics picture data, and display processing circuit means for processing said stored character and graphics picture data to suitable form for display by said display device, the improvement comprising conversion means for converting said character and graphics picture data, prior to storage in said display memory means, to compressed character and graphics picture data representing a display picture having a display density that is different from a display density specified by said display control data, and in which said character and graphics picture data include pattern data corresponding to bistate picture elements of a display picture, and said conversion means comprises first compression means for converting each of a plurality of sets of data elements of said pattern data, respectively corresponding to rectangular arrays of $m_1$ by $m_2$ of said picture elements, to a corresponding single data element in said compressed character and graphics picture data, wherein $m_1$ and $m_2$ are respective positive integers each having a value greater than one.

2. A character and graphics display apparatus according to claim 1, in which each of said pattern display elements selectively represents an "on" and an "off" state of a corresponding picture element, and in which said conversion is executed for each of said sets by establishing the display "on" state for said corresponding single display element if at least one display element of said each set represents the display "on" state, and establishing the display "off" state for the corresponding single display element if all display elements of said each set represent the display "off" state.

3. A character and graphics display apparatus according to claim 1, in which said character and graphics data include character code data, and in which said conversion means includes second compression means comprising character generating means responsive to said character code data for generating character pattern data for producing display of character patterns of compressed size by said display means.

4. In a character and graphics display apparatus for enabling substantially simultaneous display of a television picture and a set of character and graphics data by a display device, having receiving circuit means for receiving a signal carrying encoded therein character and graphics data, said character and graphics data including display control data, data memory means for storing said character and graphics data received by said receiving circuit means, data decoding means for decoding said character and graphics data to obtain character and graphics picture data, display memory means for temporarily storing said character and graphics picture data, and display processing circuit means for processing said stored character and graphics picture data to suitable form for display by said display device, the improvement comprising conversion means for converting said character and graphics picture data, prior to storage in said display memory means, to compressed character and graphics picture data representing a display picture having a display density that is different from a display density specified by said display control data and in which said character and graphics data include attribute data for specifying display attributes, said attribute data comprising attribute display elements respectively corresponding to predetermined display regions of said display device, and in which said conversion means comprises first compression means for converting each of a plurality of sets of attribute display elements, respectively corresponding to rectangular arrays of $n_1$ by $n_2$ of said display regions, to a corresponding single attribute data element, where $n_1$ and $n_2$ are respective positive integers each having a value greater than one.

5. A character and graphics display apparatus according to claim 4, in which said conversion is executed for each of said sets of attribute display elements by determining a type of attribute display element which is in the majority in said each set, and assigning said type to said corresponding single attribute display element.

6. A character and graphics display apparatus according to claim 1, in which a single page of said character and graphics picture data is transferred from said display memory to be displayed at one time by said display device.

7. A character and graphics display apparatus according to claim 1, in which a plurality of pages of said character and graphics picture data are transferred from said display memory to be displayed at one time by said display device.

8. A character and graphics display apparatus according to claim 4, in which said character and graphics data include character code data, and in which said conversion means includes second compression means comprising character generating means responsive to said character code data for generating character pattern data for producing display of character patterns of compressed size by said display means.

9. A character and graphics display apparatus according to claim 4, in which a single page of said character and graphics picture data is transferred from said display memory to be displayed at one time by said display device.

10. A character and graphics display apparatus according to claim 4, in which a plurality of pages of said character and graphics picture data are transferred from said display memory to be displayed at one time by said display device.

* * * * *